United States Patent [19]

Mertel et al.

[11] Patent Number: 4,732,098

[45] Date of Patent: Mar. 22, 1988

[54] THREAD MONITOR FOR THE BOTTOM THREAD IN THE BOBBIN OF A SEWING MACHINE

[75] Inventors: Bernhard Mertel; Erich Willenbacher, both of Kaiserslautern, Fed. Rep. of Germany

[73] Assignee: Pfaff Industriemaschinenen GmbH, Fed. Rep. of Germany

[21] Appl. No.: 870,077

[22] Filed: Jun. 3, 1986

[30] Foreign Application Priority Data

Jun. 3, 1985 [DE] Fed. Rep. of Germany ... 8516211[U]

[51] Int. Cl.[4] ..... D05B 51/00; D05B 69/36

[52] U.S. Cl. ..... 112/278; 112/231; 112/273

[58] Field of Search ..... 112/228, 231, 273, 277, 112/278, 279

[56] References Cited

U.S. PATENT DOCUMENTS

| | | | |
|---|---|---|---|
| 4,188,902 | 2/1980 | Kahan | 112/278 |
| 4,237,807 | 12/1980 | Meier et al. | 112/278 |
| 4,413,581 | 11/1983 | Logan | 112/278 |
| 4,432,297 | 2/1984 | Kemmel | 112/278 |
| 4,681,050 | 7/1987 | Kosmas | 112/278 |

*Primary Examiner*—Wm. Carter Reynolds
*Attorney, Agent, or Firm*—McGlew and Tuttle

[57] ABSTRACT

A sewing machine with a lockstitch rotary hook containing a bobbin, has a thread monitor with which light signals of a radiation source are conducted to a light receiver via inlet and outlet openings in parts of the rotary hook and in at least one of the flanges of the bobbin. For determination of a predeterminable thread and length, the hub which connects the flanges of the bobbin comprises a truncated cone-shaped region, in the surface of which the outlet opening extending substantially parallel to the axis of the hub ends.

2 Claims, 3 Drawing Figures

I
I
4
6
Z
10
11
5

1
2
3
II
II
10
11
12
13
14
15
5
4
7
6
9
8

THREAD MONITOR FOR THE BOTTOM THREAD IN THE BOBBIN OF A SEWING MACHINE

FIELD AND BACKGROUND OF THE INVENTION

The present invention relates in general to sewing machines and in particular to a new and useful thread monitor for a sewing machine with a lockstitch rotary hook for monitoring the supply of thread in the bobbin of the rotary hook.

Such a sewing machine is known from U.S. Pat. No. 3,845,320. The bobbin used in this arrangement comprises a separating wall provided next to its one flange, for separating a part of the bobbin as reserve area for a certain initial quantity of thread. The separating wall reduces the capacity of the bobbin. Also, the bobbin cannot be filled in the normal manner, but instead, first the reserve area must be filled if the arrangement is to work in the intended manner. In addition, the scanning of the thread supply occurs at a considerable distance from the hub of the bobbin.

SUMMARY OF THE INVENTION

It is the object of the present invention to design a bobbin for a sewing machine with a thread monitor for the bottom thread in such a way that with quite minor structural changes a well definable thread and length can be detected. Accordingly another object of the invention is to provide a sewing machine with a double stitch rotary hook and with a thread monitor wherein light signals of a radiation source are supplied to a light receiver providing inlet and outlet openings in parts of the rotary hook, and in at least one of the flanges of a bobbin in the rotary hook, the bobbin having a hub which connects the flanges together and which has a truncated cone-shaped region in which the outlet opening is provided extending substantially parallel to the axis of the hub.

In the new design of the bobbin the outlet is made very small and is arranged in the immediate vicinity of the hub. At its exit in the hub region the bore also has an elliptical form, as the bore extending parallel to the hub axis traverses the conical hub almost to the center. During winding of the bobbin thread, the elliptical opening is already covered up by one layer of thread, so that during unwinding of the thread, light gets from the outlet opening into the light receiver only after the bottommost layer of thread remains on the hub of the bobbin.

According to another feature of the invention, the outlet opening is made smaller than the inlet opening.

In this way enough light gets into the interior of the bobbin so that light of sufficient intensity emerges through the very small outlet opening.

A further object of the invention is to provide a thread monitor for a sewing machine which is simple in design and construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

One embodiment of the present invention is illustrated in the drawings wherein.

DESCRIPTION OF THE PREFERRED EMBODIMENT

Figure 2:
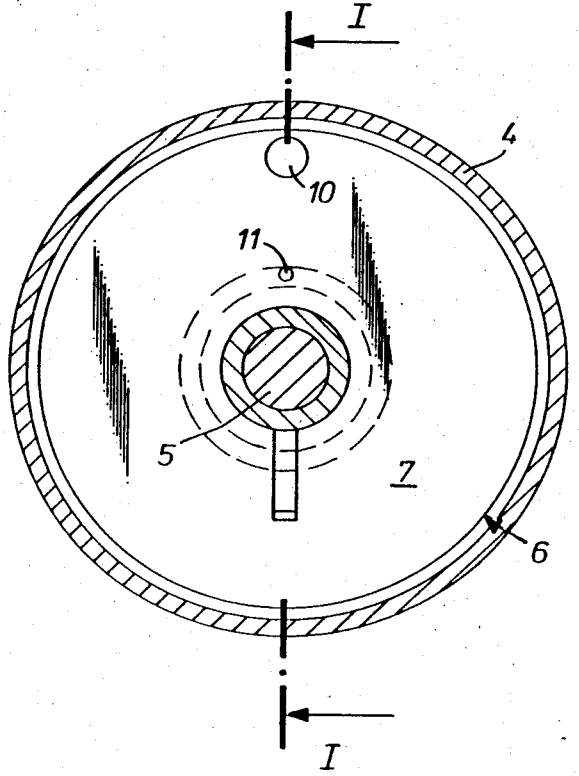
FIG. 2 is a sectional view taken along line II—II of FIG. 1.
Figure 1:
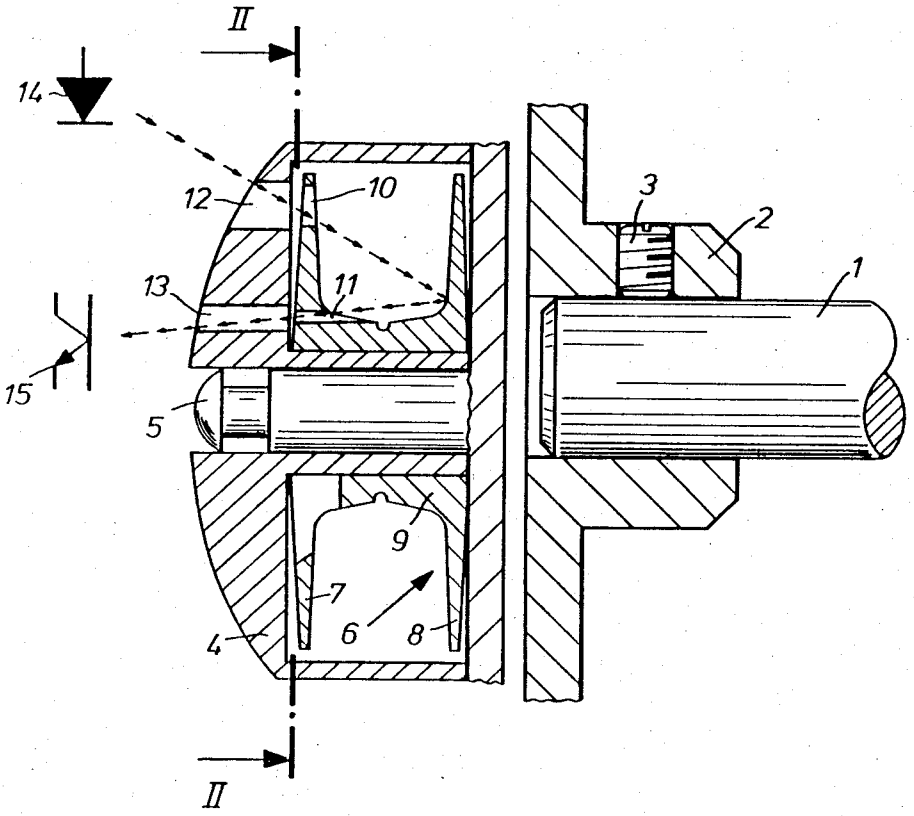
FIG. 1 is a sectional view taken through the rotary hook of a sewing machine according to the invention.

The rotary hook drive shown in FIG. 1 contains a rotary hook drive shaft 1, on which a rotary hook body 2, shown only partially, is non-rotationally fastened by a stud screw 3.

In the hook body 2 a bobbin capsule 4 is mounted in a manner not shown, which carries a center gudgeon 5 on which is mounted a bobbin 6 to be wound within a thread. The bobbin 6 is provided with a front flange 7 and a rear flange 8, which are connected by a hub 9 to be placed on the center gudgeon 5.

An inlet opening or bore 10 is provided in the outer region of flange 7, and an outlet opening or bore 11 in the region directly at the hub 9, the inlet opening 10 being several times larger than the outlet opening 11. From its center toward the connection to the flanges 7 and 8, respectively, the hub 9 has the form of a truncated cone. The outlet opening 11 is formed by a small cylindrical bore which extends from the outside of flange 7 substantially parallel to the axis of bobbin 6 and which emerges at the surface of the truncated cone-shaped region of hub 9. Due to the resulting elliptical form of the exit hole in the jacket of the truncated cone-shaped region of hub 9 there results a rather large oval cover-up region for the outlet opening 11.

The bobbin capsule 4 has an inlet opening 12 as well as an outlet opening 13, which are opposite the respective openings 10 and 11 of bobbin 6 when the latter is in a certain position. The inlet and outlet openings 12 and 13 have a larger diameter than the inlet and outlet openings 10 and 11 of bobbin 6 associated with them, in order that the path of entering and exiting light signals will not be hindered by them.

The radiation of a light emitting diode 14, indicated only symbolically, enters through the inlet openings 12 and 10, is reflected at the rear flange 8 of bobbin 6, and leaves bobbin 6 through the outlet openings 11 and 13 in order to impinge on a photodetector 15 as soon as the outlet opening 11 of bobbin 6 is no longer covered up by thread supply present on hub 9.

When the sewing machine is being driven, the bobbin capsule 4 stands still, while the shuttle body 2 revolves. During the sewing process, bobbin 6 rotates at a very low speed due to the pull-off of thread. Owing to this, the radiation can be conducted from the diode 14 to the photo detector 15 only in the position of bobbin 6 shown in FIG. 1, when the inlet openings 10 and 12 as well as the outlet openings 11 and 13 are aligned with one another, so that the photodetector 15 receives only a relatively short signal each time.

Figure 3:
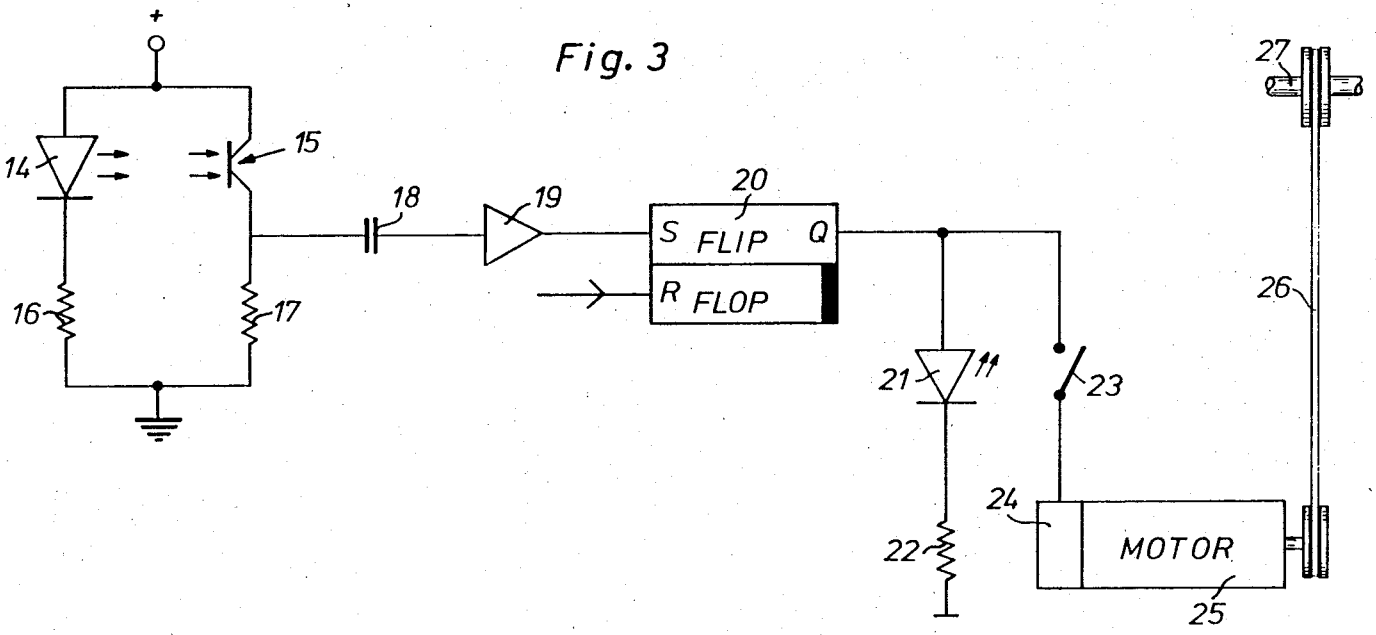
FIG. 3 is a simplified wiring diagram for the control of the thread supply monitor.

FIG. 3 shows a simplified wiring diagram, of the components required by the function of the electric control of the thread monitor. From the positive pole of a regulated voltage source current flows via the light emitting diode 14 and a resistor 16 to ground. In like manner current flows from the positive pole of the voltage source via the photo detector 15 designed as photo transistor and via a resistor 17 to ground.

At the emitter of the photo detector 15 a capacitor 18 is connected, which is connected via an amplifier 19 to the setting input S of a flip-flop memory 20. The output Q of memory 20 is connected to a display element 21 which is connected to ground via a resistor 22. At the output Q, in addition, a switch 23 connected to a turn-off device 24 of a drive motor 25 is connected which drives a main shaft 27 of the sewing machine via a V-belt 26.

The arrangement operates as follows:

During operation of the sewing machine, light or infrared radiation, depending on the design of the light emitting diode 14, falls on the opening 12 of the bobbin capsule 4 and through opening 10 of bobbin 6 onto flange 8. As soon as the bottom thread on bobbin 6 has been used up to the extent that a part of the radiation reflected by flange 8 can pass through the outlet opening 11 of bobbin 6, this radiation impinges on the photo detector 15. The photo conductor will then conduct, and current flows via resistor 17 to ground. The voltage building up is supplied via the capacitor 18 and amplifier 19 to the setting input S of memory 20. The capacitor 18 serves advantageously to filter out direct currents caused by daylight and alternating currents of low frequency caused by machine light.

With the first pulse of the photo detector 15 the memory 20 turns on via its output Q the display element 21, which indicates to the operator the imminent end of the thread supply on bobbin 6. With switch 23 closed, the output Q bf memory 20 actuates at the same time also the turn-off device 24, which can, for example, either disconnect immediately or prevent restarting of the drive motor 25 after the next stopping process, depending on the design of the drive motor 25.

Appropriately both flanges 7 and 8 of bobbin 6 are provided with inlet and outlet openings 10 and 11 aligned with one another, so that the function of the thread monitor is ensured in any position of insertion of bobbin 6 in the bobbin capsule 4.

While a specific embodiment of the invention has been shown and described in detail to illustrate the application of the principles of the invention, it will be understood that the invention may be embodied otherwise without departing from such principles.

What is claimed is:

1. A thread monitor for a sewing machine having a lockstitch rotary hook comprising a bobbin capsule connected to the rotary hook and defining an inner space with an axis, a bobbin mounted for rotation in the space around the axis, said bobbin having a hub with an outer truncated cone-shaped region and a pair of flanges connected at space locations to said hub, said capsule having an inlet opening communicating with said space and an outlet opening spaced from said inlet opening and communicating with said space, at least one flange having an inlet opening alignable with said inlet opening of said capsule and an outlet opening alignable with said outlet opening of said capsule and extending substantially parallel to said axis through a portion of said truncated cone-shaped hub, a radiation source positioned to shed radiation on said inlet opening of said capsule and a radiation detector positioned to receive light from said outlet of said capsule which is reflected from said bobbin.

2. A thread monitor according to claim 1 wherein said outlet opening through said hub is elliptical in said truncated cone-shaped hub, said outlet opening being much smaller than said inlet opening through said flange.

* * * * *